US007806788B1

(12) United States Patent
Neuman

(10) Patent No.: US 7,806,788 B1
(45) Date of Patent: Oct. 5, 2010

(54) PITCHING MACHINE

(76) Inventor: Daniel R. Neuman, 9800 Mansion Rd., Loami, IL (US) 62661

( * ) Notice: Subject to any disclaimer, the term of this patent is extended or adjusted under 35 U.S.C. 154(b) by 239 days.

(21) Appl. No.: 12/157,032

(22) Filed: Jun. 6, 2008

Related U.S. Application Data

(60) Provisional application No. 60/933,534, filed on Jun. 7, 2007.

(51) Int. Cl.
*A63B 69/00* (2006.01)

(52) U.S. Cl. ..... 473/451; 473/422; 124/4; 124/6; 124/7; 124/8; 124/78; 124/81; 124/82

(58) Field of Classification Search ..... 124/4, 124/6, 7, 8, 78, 81, 82; 473/422, 451, 499
See application file for complete search history.

(56) References Cited

U.S. PATENT DOCUMENTS 1,211,738 A * 1/1917 Marty ..... 124/6
1,707,726 A * 4/1929 Jeter ..... 124/7
2,716,973 A * 9/1955 Desi ..... 124/78
2,806,461 A * 9/1957 Giovagnoli ..... 124/7
3,128,752 A * 4/1964 Andersen ..... 124/16
3,306,613 A * 2/1967 Mainers ..... 473/436
3,470,859 A * 10/1969 Ponza ..... 124/7
3,572,308 A * 3/1971 Smith ..... 124/7
3,777,732 A * 12/1973 Holloway et al. ..... 124/78
4,086,903 A * 5/1978 Scott ..... 124/78
4,195,614 A * 4/1980 Ponza ..... 124/1
4,209,004 A * 6/1980 Kennedy ..... 124/7
4,262,648 A * 4/1981 Wegener et al. ..... 124/6
4,269,162 A * 5/1981 Abraham et al. ..... 124/7
4,323,047 A * 4/1982 McIntosh et al. ..... 124/1
4,372,284 A * 2/1983 Shannon et al. ..... 124/78
4,391,264 A * 7/1983 Abraham et al. ..... 124/50
4,409,953 A * 10/1983 Kennedy et al. ..... 124/7
4,458,656 A * 7/1984 Giovagnoli ..... 124/7
4,559,918 A * 12/1985 Ballerin et al. ..... 124/78
4,583,514 A * 4/1986 Nozato ..... 124/78
4,672,942 A * 6/1987 Steward ..... 124/1
4,705,014 A * 11/1987 Kahelin ..... 124/1
4,784,107 A * 11/1988 Kelly ..... 124/61
4,823,763 A * 4/1989 Ponza ..... 124/78
4,841,945 A * 6/1989 Braden ..... 124/78
4,844,045 A * 7/1989 Powell et al. ..... 124/7
4,860,717 A * 8/1989 Powell et al. ..... 124/7
4,995,371 A * 2/1991 Kuizinas ..... 124/7
5,046,476 A * 9/1991 Nozato ..... 124/78
5,121,735 A * 6/1992 Hancock ..... 124/7
5,285,765 A * 2/1994 Lee ..... 124/50
5,344,137 A * 9/1994 Komori ..... 124/36
5,359,986 A * 11/1994 Magrath et al. ..... 124/78
5,417,196 A * 5/1995 Morrison et al. ..... 124/6

(Continued)

*Primary Examiner*—Gene Kim
*Assistant Examiner*—Alexander R Niconovich
(74) *Attorney, Agent, or Firm*—Philip L. Bateman

(57) ABSTRACT

A pitching machine contains a pitching arm that vertically rotates at a speed of about 5 to 15 rpm, picks up a ball from the ball cradle at a pick-up point in its rotation, and then releases the ball at a release point in its rotation to provide a first velocity component to the ball. The pitching machine also contains a wheel that vertically rotates at a speed of about 300 to 3000 rpm. The wheel is positioned at the release point of the pitching arm to provide a second velocity component to the ball and to pitch the ball at an initial launch angle.

10 Claims, 4 Drawing Sheets

U.S. PATENT DOCUMENTS 5,437,261 A * 8/1995 Paulson et al. ..... 124/78
5,464,208 A * 11/1995 Pierce ..... 473/451
5,562,282 A * 10/1996 Stevenson ..... 124/7
5,619,977 A * 4/1997 Gatin ..... 124/7
5,749,797 A * 5/1998 Sunseri et al. ..... 473/451
5,826,568 A * 10/1998 Van Ross, Jr. ..... 124/6
5,927,262 A * 7/1999 Bixler ..... 124/81
5,975,527 A * 11/1999 Winchester ..... 273/129 V
5,979,426 A * 11/1999 Troklus et al. ..... 124/78
6,082,350 A * 7/2000 Crews et al. ..... 124/78
6,093,117 A * 7/2000 Sherlock et al. ..... 473/422
6,129,076 A * 10/2000 Powell et al. ..... 124/7
6,237,583 B1 * 5/2001 Ripley et al. ..... 124/78
6,305,366 B1 * 10/2001 Rizzo et al. ..... 124/6
6,402,640 B1 * 6/2002 Stuart ..... 473/422
6,415,782 B1 * 7/2002 Holland ..... 124/78
6,440,013 B1 * 8/2002 Brown ..... 473/422
6,443,140 B1 * 9/2002 Crews et al. ..... 124/78
6,470,873 B2 * 10/2002 Battersby et al. ..... 124/78
6,505,617 B1 * 1/2003 Neuman ..... 124/7
6,508,243 B1 * 1/2003 Long ..... 124/1
6,637,418 B1 * 10/2003 Suba et al. ..... 124/6
6,675,792 B2 * 1/2004 Suba et al. ..... 124/78
6,705,305 B2 * 3/2004 Suba et al. ..... 124/78
6,739,325 B1 * 5/2004 Paulson ..... 124/78
6,820,605 B1 * 11/2004 Suba et al. ..... 124/6
6,880,542 B1 * 4/2005 Johndreau et al. ..... 124/78
7,011,084 B2 * 3/2006 Richard ..... 124/78
7,032,585 B2 * 4/2006 Johndreau et al. ..... 124/78
7,040,309 B2 * 5/2006 Johndreau et al. ..... 124/80
7,082,938 B2 * 8/2006 Wilmot ..... 124/78
7,100,594 B2 * 9/2006 Boehner ..... 124/78
7,111,620 B2 * 9/2006 Johndreau et al. ..... 124/51.1
7,278,934 B2 * 10/2007 McBride et al. ..... 473/451
7,383,832 B2 * 6/2008 Soberg ..... 124/6
7,445,003 B2 * 11/2008 Smith ..... 124/78
7,553,244 B2 * 6/2009 York ..... 473/438
7,610,909 B2 * 11/2009 Greene, Jr. ..... 124/78
7,628,147 B2 * 12/2009 Estalella ..... 124/7
2001/0008755 A1 * 7/2001 Battersby ..... 434/247
2001/0018912 A1 * 9/2001 Battersby et al. ..... 124/78
2002/0023634 A1 * 2/2002 Caldwell ..... 124/78
2002/0134367 A1 * 9/2002 Delso ..... 124/82
2002/0174859 A1 * 11/2002 Suba et al. ..... 124/78
2003/0040381 A1 * 2/2003 Richings et al. ..... 473/415
2003/0195061 A1 * 10/2003 Brown ..... 473/415
2004/0261778 A1 * 12/2004 Wilmot ..... 124/78
2005/0092311 A1 * 5/2005 Johndreau et al. ..... 124/78
2005/0103319 A1 * 5/2005 Hudson et al. ..... 124/78
2005/0121016 A1 * 6/2005 Johndreau et al. ..... 124/78
2005/0161034 A1 * 7/2005 Johndreau et al. ..... 124/78
2005/0209027 A1 * 9/2005 Joseph ..... 473/431
2006/0118096 A1 * 6/2006 Cucjen et al. ..... 124/78
2006/0135290 A1 * 6/2006 Lin ..... 473/451
2006/0137672 A1 * 6/2006 Smith ..... 124/78
2006/0236993 A1 * 10/2006 Cucjen et al. ..... 124/78
2006/0287137 A1 * 12/2006 Chu ..... 473/422
2007/0191143 A1 * 8/2007 Kelly et al. ..... 473/451
2008/0184979 A1 * 8/2008 Estalella ..... 124/16
2009/0120421 A1 * 5/2009 Chu ..... 124/78
2009/0260611 A1 * 10/2009 Grant et al. ..... 124/78
2009/0260612 A1 * 10/2009 Grant et al. ..... 124/78
2009/0283088 A1 * 11/2009 Laszlo et al. ..... 124/78

* cited by examiner 70
39
38
54

PITCHING MACHINE

CROSS-REFERENCE TO RELATED APPLICATION

This application claims the benefit of U.S. Provisional Application Ser. No. 60/933,534, Jun. 7, 2007.

FIELD OF THE INVENTION

This invention relates to mechanical guns and projectors. More particularly, this invention relates to ball pitching machines with rotating arms and wheels.

BACKGROUND OF THE INVENTION

Baseball is one of the most popular games in the United States, Japan, and many Caribbean countries. The game is so popular in the United States that it is known as "the national pastime." The game features a player with a bat attempting to hit a ball pitched by an opposing player through a rectangular "strike zone" adjacent the batter. To hit the pitched ball, the batter must swing the bat at exactly the right place and time.

Several variations of baseball are widely played. In the form most widely played by boys and young men, the pitcher throws a hard ball having a circumference of about nine inches overhanded. This form of baseball is sometimes known as "hardball." In the form most widely played by girls and young women, the pitcher throws a ball having a circumference of about twelve inches underhanded. This form of baseball is commonly known as "softball." Older men and women often play a form of softball commonly known as "slow pitch softball" which is similar to conventional softball, except the pitcher throws the ball at a slower speed and with a much greater arc. The term "baseball" is used herein to include all variations of the game and, as the context requires, to also refer to all types of balls used to play the game. Due to the tremendous growth of competitive sports for girls, softball is growing rapidly in popularity in the United States. Most high schools and many colleges now have girls softball teams.

Techniques have been developed that enable a top men's softball pitcher to throw the ball at speeds in excess of about ninety miles per hour. The top high school girl pitchers are able to throw the ball at speeds in excess of about fifty miles per hour. The pitching motion features a windmill motion with the arm, a strong push off the pitcher's mound with the lower body, and a "snap" of the wrist at release. The snap of the wrist enables the ball to be thrown at a velocity substantially greater than that generated by the motion of the arm and the rest of the body. The ball reaches the batter so quickly that a batter must begin to swing the bat as the pitcher begins the pitching motion. The batter must make a split-second decision after the ball is released to continue the swing or to stop it.

A variety of machines have been developed to pitch baseballs and/or softballs to batters for practice. A first type of machine features one or more rapidly spinning wheels that fling the ball to the batter. An example of such a machine is disclosed in Lin, U.S. Pat. Appln. Publn. No. 2006/0135290, pub. Jun. 22, 2006. These machines are unsatisfactory because they do not simulate the motion of an actual pitcher. In particular, the batter's sense of timing is not improved because he or she cannot coordinate the beginning of the swing with the motion of an arm.

A second type of pitching machine features a reciprocating pitching arm. Examples of such machines are disclosed in Smith, U.S. Pat. No. 3,572,308, issued Mar. 23, 1971; Kuizinas, U.S. Pat. No. 4,995,371, issued Feb. 26, 1991; and Stevenson, U.S. Pat. No. 5,562,282, issued Oct. 8, 1996. The pitching arms of these machines travel through an arc of only about 90 degrees before releasing the ball and rely solely upon the speed attained by the arm during this arc to provide velocity to the pitched ball. In other words, the speed of the machine's pitching arm is much faster than the speed of a real person's pitching arm. As a result, the batter cannot coordinate the beginning of the swing with the motion of the arm.

A third type of pitching machine features a windmill pitching arm that rotates 360 degrees and relies solely upon the speed of the arm to provide the velocity of the pitched ball. Examples of such machines are disclosed in Hunsicker, U.S. Pat. No. 3,640,262, issued Feb. 8, 1972; and Hancock, U.S. Pat. No. 5,121,735, issued Jun. 16, 1992. Although these pitching arms rotate 360 degrees during the pitching cycle, the arc from the point where the ball is picked up to the point where the ball is released is still only about 90 degrees. Because these machines rely solely upon the speed attained by the arm during this arc to provide velocity to the pitched ball, the batter cannot coordinate the beginning of the swing with the motion of the arm.

A fourth type of pitching machine is disclosed in Neuman, U.S. Pat. No. 6,505,617, issued Jan. 14, 2003, which is incorporated by reference. The Neuman pitching machine features a windmill pitching arm that rotates 360 degrees, including an arc of about 200 to 250 degrees at a high speed, with a flip lever that adds to the velocity of the pitched ball. The Neuman closely simulates the pitching motion and release of a human pitcher. The only disadvantage of the Neuman pitching machine is that the pitching arm strikes a stop member with so much force that the machine must be very sturdy. Accordingly, the Neuman pitching machine is relatively heavy and expensive.

Accordingly, there is a demand exists for a windmill pitching machine that closely simulates the pitching motion of a human pitcher and is also relatively light in weight and inexpensive.

SUMMARY OF THE INVENTION

The general object of this invention is to provide an improved windmill pitching machine. A particular object is to provide a windmill pitching machine that closely simulates the pitching motion of a human pitcher and is also relatively light in weight and inexpensive.

I have invented an improved windmill pitching machine. The pitching machine comprises: (a) a frame having a ball magazine and a ball cradle supplied by the ball magazine; (b) a pitching arm that vertically rotates at a speed of about 5 to 15 rpm in a first direction and that picks up a ball from the ball cradle at a pick-up point in its rotation and that releases the ball at a release point in its rotation to provide a first velocity component to the ball; and (c) a wheel that vertically rotates at a speed of about 300 to 3000 rpm in a direction that is opposite that of the pitching arm, the wheel positioned at the release point of the pitching arm to provide a second velocity component as the ball is pitched at a trajectory.

The pitching machine of this invention simulates the pitching motion of a human pitcher because of its rotating pitching arm. It further simulates the snap of the wrist because of the rotating wheel provides additional velocity. The pitching machine is relatively light in weight and inexpensive to manufacture.

DETAILED DESCRIPTION OF THE INVENTION

Figure 1:
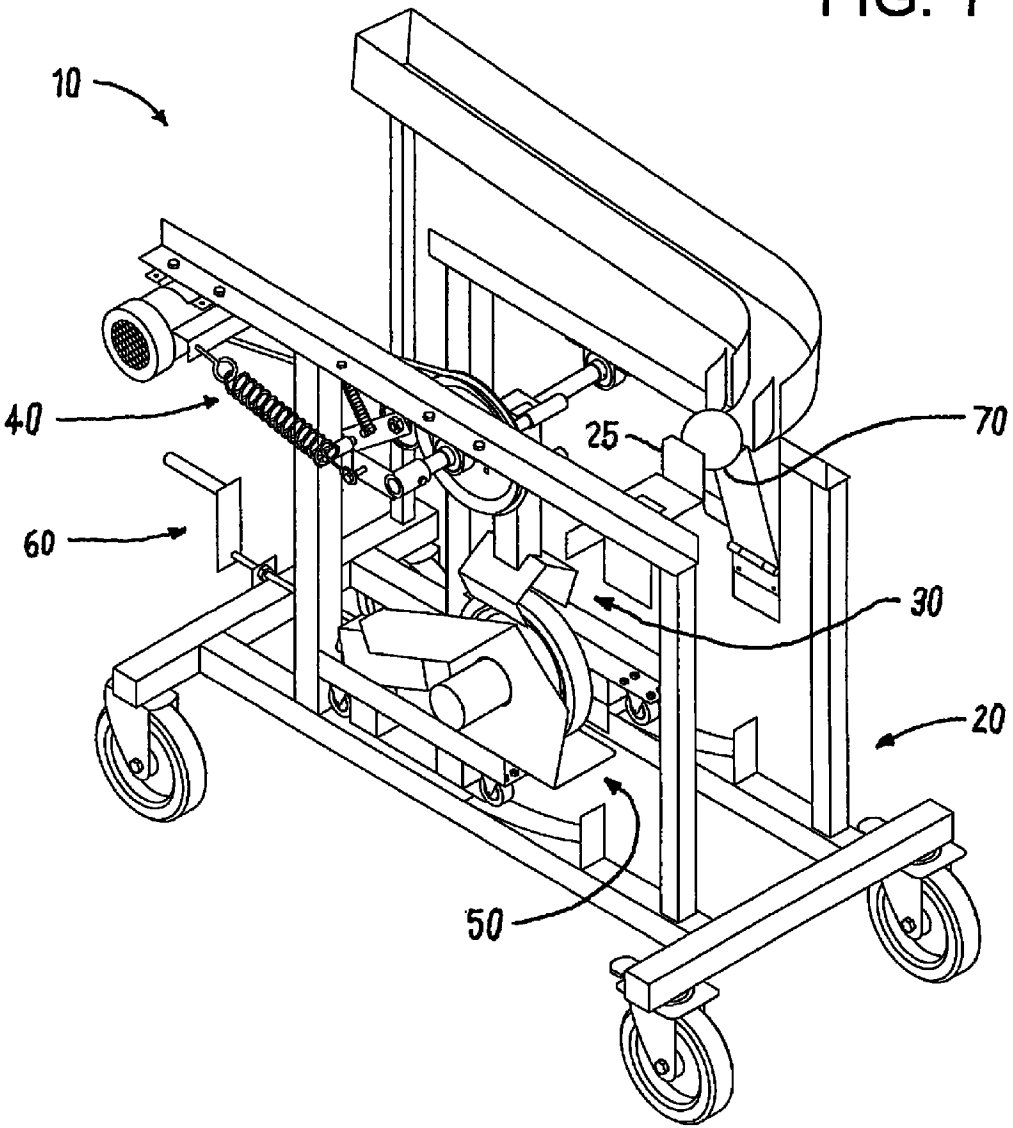
FIG. 1 is a perspective view of a preferred embodiment of the pitching machine of this invention.
Figure 2:
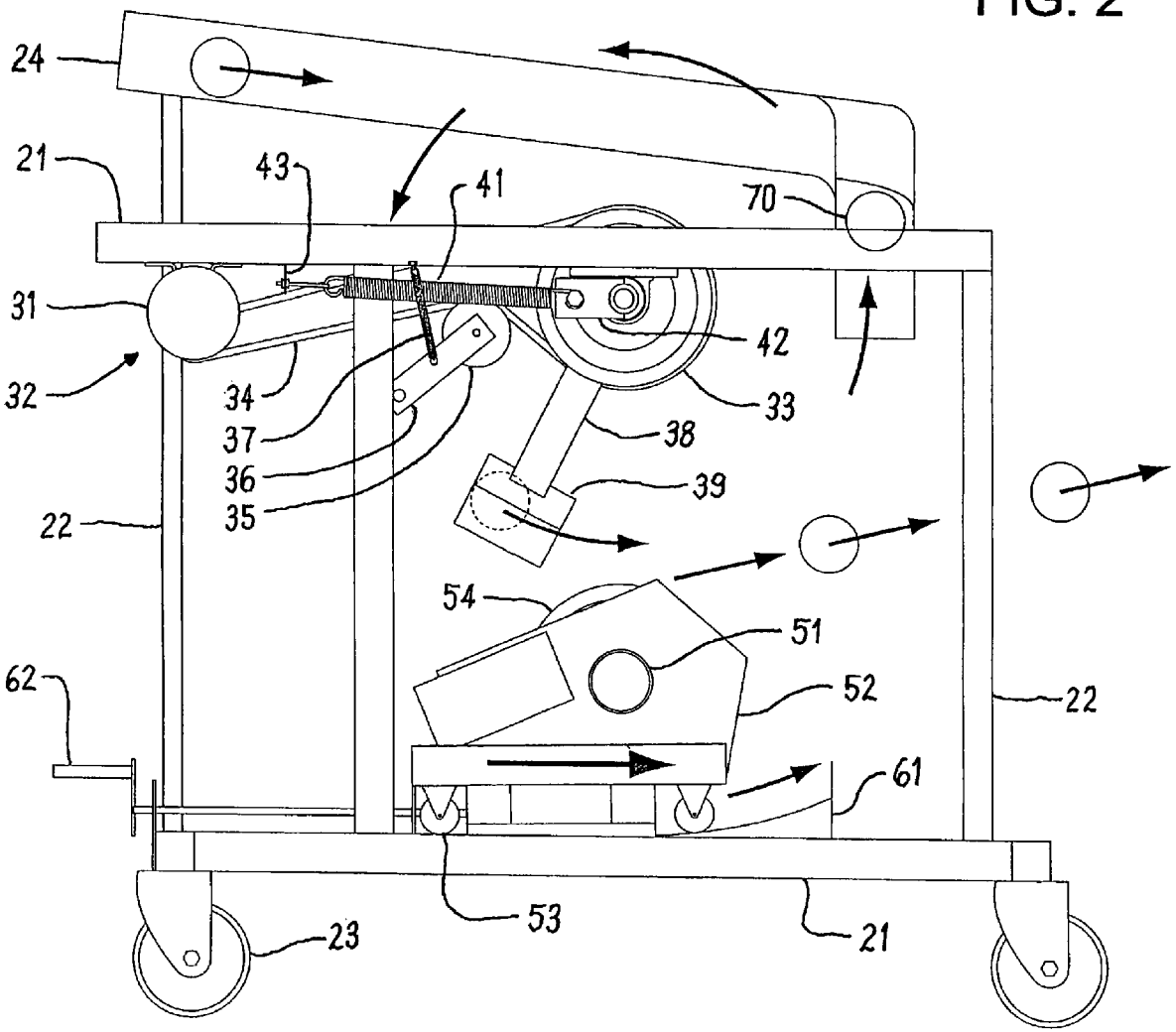
FIG. 2 is a side elevation view thereof.

This invention is best understood by reference to the drawings. Referring first to FIGS. 1 and 2, the pitching machine 10 of this invention comprises a frame 20, a windmill pitching arm assembly 30 including an optional pitching arm acceleration assembly 40, and a pitching wheel assembly 50 including an optional launch angle adjustment assembly 60. Each of these components is discussed in detail below.

1. Frame

The frame 20 provides the overall structure of the pitching machine and the other components are attached to it. The frame includes upper and lower horizontal members 21 and front and rear vertical members 22. If it is desired to move the pitching machine from place to place, the frame sits on wheels 23. If the frame sits on wheels, it may be desirable to include brakes, stands, wheel chocks, or the like (not shown) to prevent any movement while the pitching machine is in operation.

The frame contains a ball magazine 24 consisting of an inclined ramp that holds a quantity of balls 70. The outlet of the magazine is open and spaced a short distance apart from a plate 25, thus creating a gap. The width of the gap, i.e., the distance between the magazine outlet and the plate, is less than the circumference of the ball so the leading ball in the magazine is wedged in position where it can be picked up by the pitching arm, as discussed below. The gap between the magazine outlet and the plate thus functions as a ball cradle.

2. Pitching Arm Assembly

The windmill pitching arm assembly 30 is mounted onto the frame. The assembly simulates the motion of the arm of a live pitcher. As previously mentioned, a windmill pitching arm rotates 360 degrees. The direction of the rotation is indicated by four curved arrows in FIG. 2. The assembly includes an electric motor 31 with a drive pulley 32 mounted onto its drive shaft. The speed of the electric motor is preferably adjustable so that the rotational speed of the pitching arm can be varied. The drive pulley turns a driven pulley 33 by means of a drive belt 34. In FIGS. 1 and 2, the drive pulley is hidden from view behind the motor. The driven pulley is positioned on a shaft extending between two bearings mounted on the underside of the upper horizontal frame members. An idler pulley 35 provides tension to the belt. The idler pulley is mounted on a pivoting idler pulley bracket 36 that is biased upward by idler pulley spring 37 that is attached to an upper horizontal frame member.

The pitching arm 38 is mounted radially on a shaft that turns at the same speed as the driven pulley. The pitching arm travels in a generally vertical path about a generally horizontal axis defined by the shaft. A channel shaped ball holder 39 with a closed back is attached to the distal end of the pitching arm. The ball holder is shaped to hold a ball against its back surface as it rotates and is open at the bottom to allow the ball to come into direct contact with the pitching wheel. The pitching arm and ball holder are both plainly visible from the front. As discussed in detail below, this visibility enables a batter to time his or her swing with the motion of the pitching arm, just as a batter does with a live pitcher.

The speed at which the pitching arm rotates determines the frequency with which a ball is pitched. In other words, if the pitching arm rotates at six revolutions per minute, a ball is pitched every ten seconds. The pitching arm generally rotates at about five to fifteen revolutions per minute so that a ball is pitched about every four to twelve seconds. As discussed below, the speed at which the pitching arm rotates also has a minor effect on the velocity of the pitched ball.

3. Acceleration Assembly

It is preferable to include an acceleration assembly 40 to the pitching arm assembly that causes the pitching arm to accelerate during a portion of the rotation and to decelerate during the remainder of the rotation. Without such an assembly, the pitching arm rotates at a constant speed and is either too slow to simulate a softball pitcher's arm (if the time period between pitched balls is optimal) or the time period between pitched balls is too short (if the speed of the softball pitcher's arm is simulated).

In the preferred embodiment, the acceleration assembly consists of a horizontal main spring 41 that uncoils and recoils between a rotating pulley bracket 42 and a stationary frame bracket 43. The rotating pulley bracket is mounted on the same shaft as the driven pulley and rotates with it. The pulley bracket is positioned so that it always trails the pitching arm by about 60 degrees. For example, in FIG. 2, the counterclockwise rotating pitching arm is at the 7 o'clock position and the bracket is at the 9 o' clock position.

It can be appreciated that the main spring biases the pitching arm to the 7 o'clock position (i.e., about 30 degrees before the ball is released) and the bracket to the 9 o'clock position as shown in FIG. 2. In other words, the main spring is at its minimum length in this position. It can also be appreciated that the main spring is at its maximum length when the pitching arm is at the 1 o'clock position and the bracket is at the 3 o'clock position. The effect of the spring is to accelerate the pitching arm from the 1 o'clock position (just after a ball is picked up) to the 7 o'clock position (just before the ball is released). Similarly, the effect of the spring is to decelerate the pitching arm from the 7 o'clock position to the 1 o'clock position. The importance of this acceleration and deceleration of the pitching arm is discussed in detail below.

4. Pitching Wheel Assembly

The pitching wheel assembly 50 is mounted onto, suspended from, rests upon, or is otherwise connected to the frame. The pitching wheel assembly simulates the snap of a live pitcher's wrist in that it provides a substantial increase in velocity of a pitched ball at release. The assembly of the preferred embodiment includes an electric motor 51 mounted within a housing 52 on wheels 53 that rest upon the lower horizontal members of the frame. The electric motor rotates one or more pitching wheels.

The pitching wheel assembly of the preferred embodiment contains a single pitching wheel 54. The rotational speed of the electric motor is generally about 300 to 3000 revolutions per minute and is preferably adjustable. The diameter of the pitching wheel is generally about nine to eighteen inches. The outer surface of the pitching wheel is made of a material that has a high coefficient of friction with the ball so that slippage during ball contact (and a corresponding loss in velocity) is minimized. The outer surface is preferably made of a synthetic elastomer such as polyurethane or a natural elastomer such as rubber.

The velocity imparted by the pitching wheel assembly is equal to the angular velocity of the wheel assuming no slippage between the ball and the wheel. The angular velocity of the wheel is, in turn, a function of the rotational speed and circumference of the wheel. For example, if the wheel rotates at 1000 revolutions per minute and the circumference of the wheel is 3.14 feet (a diameter of one foot), the angular velocity of the wheel and the velocity imparted to the ball are about 36 miles per hour as shown in the following calculation:

$$\text{Ball velocity} = (1000\ \text{revolutions/minute})(3.14\ \text{feet/revolution})$$

$$(1\ \text{mile}/5280\ \text{feet})(60\ \text{minutes/hour})$$

$$\text{Ball velocity} = 36\ \text{miles per hour}$$

The ball velocity is generally about 25 to 60 miles per hour. The desired speed depends in large part on the typical speed that a batter will face when batting against a live pitcher. A preferred pitching wheel assembly is provided by modifying a COBRA JR. single wheel pitching machine manufactured by Omni Sports Technologies of Memphis, Tenn.

5. Launch Angle Adjustment Assembly

It is preferable to include a launch angle adjustment assembly 60 to the pitching wheel assembly that enables the initial launch angle of the ball to be quickly and easily adjusted. The combination of the velocity and the launch angle determine the trajectory (or arc) traveled by the ball. The trajectory must deliver the pitched balls into the strike zone of the batter. In the preferred embodiment, the launch angle adjustment assembly consists of two ramps 61 and a screw crank 62. The screw crank moves the pitching wheel assembly up (as indicated by the two arrows in FIG. 2) or down the ramps. As the pitching wheel assembly goes further up the ramps, the launch angle of the ball increases. The launch angle is indicated by the two balls and three arrows in FIG. 2.

Other mechanisms that change the angle of the pitching wheel assembly and/or the frame are equally suitable. For example, another suitable mechanism is a tube, the upper end of which pivots from an upper horizontal frame member and the lower end of which is connected to the pitching wheel assembly. Movement of the screw crank pivots the entire assembly forward to increase the launch angle.

6. Operation

The operation of the pitching machine can now be considered. FIGS. 3 to 7 illustrate five stages of a pitching cycle. From the point of view shown, the pitching arm rotates in a counter-clockwise direction and the pitching wheel rotates in a clockwise direction as indicated by the two curved arrows. For illustration purposes, the ball holder 39 is shown truncated so a lower portion of the ball is visible. The ball holder is also spaced apart from the pitching wheel they do not contact. While this truncated structure is suitable, the ball holder in the preferred embodiment overlaps and straddles the pitching wheel as shown in FIGS. 1 and 2.

Figures 3, 4, 5, 6, 7:
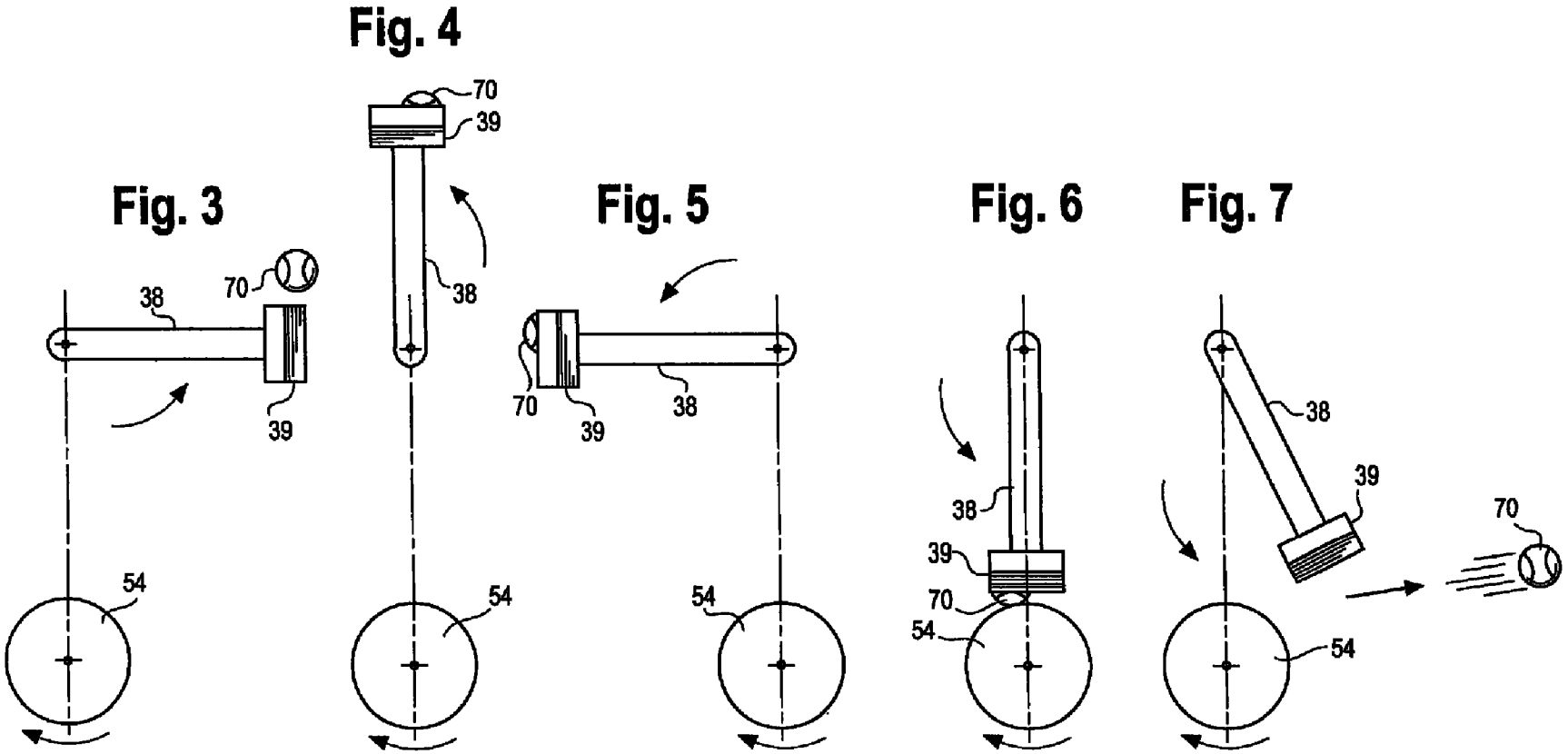
FIG. 3 is a side elevation view showing selected components of the machine in a first stage of a pitching cycle.
FIG. 4 is a side elevation view showing selected components in a second stage of a pitching cycle.
FIG. 5 is a side elevation view showing selected components in a third stage of a pitching cycle.
FIG. 6 is a side elevation view showing selected components in a fourth stage of a pitching cycle.
FIG. 7 is a side elevation view showing selected components in a fifth stage of a pitching cycle.
Figure 8:
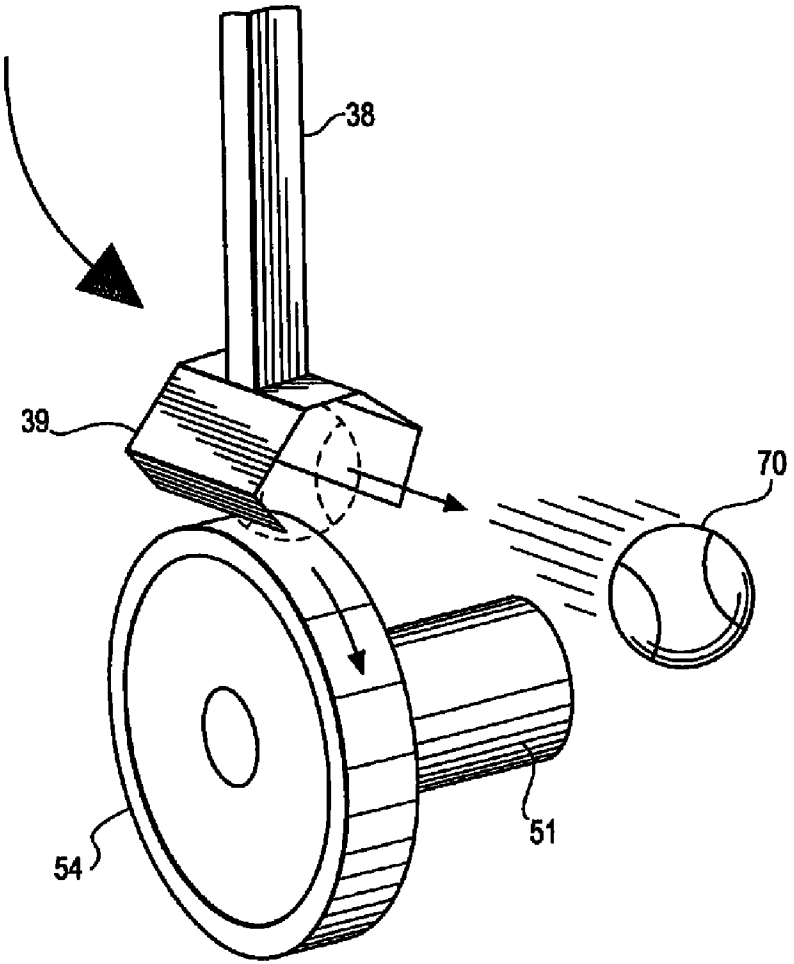
FIG. 8 is a detailed perspective view of selected components showing a ball at release.

Turning to FIG. 3, the pitching machine is shown at a first stage when the pitching arm and ball holder are about to pick up a ball 70 from the ball cradle. This stage can be identified as the three o'clock position based on the position of the pitching arm. In FIG. 4, the pitching arm has reached the twelve o'clock position and has begun to accelerate rapidly due to the action of the main spring previously discussed. In FIG. 5, the pitching arm has rotated to the nine o'clock position and continues to accelerate. In FIG. 6, the ball holder has just reached the pitching wheel. In FIG. 7, the pitching wheel has propelled the ball out of the cradle and toward the batter at a high velocity as indicated by the straight arrow. The point of contact between the ball and the pitching wheel is shown in more detail in FIG. 8.

The pitching machine is easily adjusted to best suit the preferences of the batter. The speed of the arm rotation is adjusted by varying the speed of the electric motor. The arm rotation speed can also be adjusted by changing the circumferences (diameters) of the drive pulley and driven pulley.

The angular speed of the wheel is adjusted by varying the speed of the electric motor or by changing the diameter of the wheel.

The launch angle of the pitched ball is adjusted by changing the angle of the pitching wheel assembly and/or the frame. In the preferred embodiment, this is done by moving the assembly up or down along the ramps.

7. Features and Alternate Embodiments

The pitching machine of this invention closely simulates the motion of a live pitcher and, therefore, provides much more realistic and beneficial practice for a batter. The pitching arm simulates the windmill motion of a live pitcher's arm and the pitching wheel simulates the velocity increase achieved by the snap of a live pitcher's wrist. In addition, the pitching machine is relatively light in weight, quiet in operation, and inexpensive to manufacture.

While the preferred embodiment of the pitching machine is adapted for pitching softballs underhanded at a relatively high speed, it is understood that any similar sized balls (for example, baseballs and tennis balls) can also be pitched by the machine. Depending on the diameter of the ball, an adjustment of the ball cradle (i.e., the width of the gap between the magazine outlet and the plate) may have to be adjusted. It is also understood that the pitching machine can pitch softballs at a relatively low speed and with a relatively high trajectory by reducing the speed and increasing the launch angle.

Figure 9:
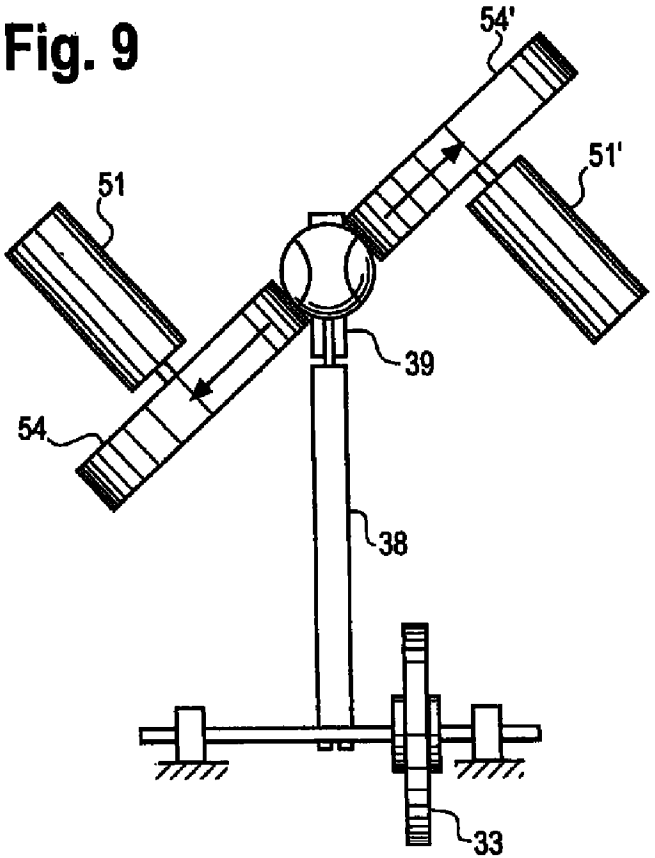
FIG. 9 is a front elevation view of selected components of a second embodiment of the pitching machine.

It is further understood that an alternate embodiment of the pitching machine contains a pitching arm that rotates in the opposite direction and contacts the wheel at the upper point of the rotation. This embodiment simulates an overhanded throw. Selected components from an overhanded embodiment are shown in FIG. 9. This particular embodiment contains two wheels 54 and 54' that are spaced apart the exact width of the ball. The wheels are reclined between horizontal and vertical. Their angular speeds are independently controlled by variable speed motors 51 and 51'. Operating the two wheels at different speeds enables side spin to be applied to the ball as it is propelled. If the amount of the side spin is sufficient, the ball will curve in the same manner as a curve ball thrown by a live pitcher.

I claim:

1. A pitching machine for pitching a ball to a batter, the pitching machine comprising:

(a) a frame having a ball magazine and a ball cradle supplied by the ball magazine;

(b) a pitching arm that rotates 360 degrees at a speed of about 5 to 15 rpm, that picks up a ball from the ball cradle at a pick-up point in its rotation, and that releases the ball at a release point in its rotation to provide a first velocity component to the ball; and (c) a wheel that rotates at a speed of about 300 to 3000 rpm, the wheel positioned at the release point of the pitching arm to provide a second velocity component to the ball as it is pitched at an initial launch angle toward a batter;

the pitching machine being sufficiently free of obstructions between the pitching arm and the batter so that the pitching arm is visible by the batter throughout its entire 360 degree rotation.

2. The pitching machine of claim 1 additionally comprising a means for adjusting the rotation speed of the wheel.

3. The pitching machine of claim 2 additionally comprising a means for adjusting the rotation speed of the pitching arm.

4. The pitching machine of claim 3 additionally comprising a means for adjusting the initial launch angle of the pitched ball.

5. The pitching machine of claim 4 additionally comprising a means for accelerating the pitching arm as it moves from the pick-up point to the release point, and for decelerating the pitching arm as it moves from the release point to the pick up point.

6. A pitching machine for pitching a ball to a batter, the pitching machine comprising:

(a) a frame having a ball magazine for holding a plurality of balls and a ball cradle supplied by the ball magazine;

(b) a pitching arm that rotates 360 degrees on a generally vertical path about a generally horizontal axis, the pitching arm containing a ball holder at its distal end that picks up a ball from the ball cradle at a pick-up point in its rotation, and that releases the ball at a release point in its rotation; and (c) a wheel that rotates 360 degrees, the wheel positioned at the release point to propel the ball from the ball holder toward a batter;

the pitching machine being sufficiently free of obstructions between the pitching arm and the batter so that the pitching arm is visible by the batter throughout its entire 360 degree rotation.

7. The pitching machine of claim 6 additionally comprising an acceleration assembly that accelerates the pitching arm during a portion of the rotation just prior to ball release and decelerates the pitching arm during a portion of the rotation just after ball release.

8. The pitching machine of claim 7 wherein the pitching arm and wheel are powered by variable speed motors.

9. The pitching machine of claim 8 wherein the acceleration assembly comprises a spring.

10. The pitching machine of claim 9 additionally comprising a second wheel positioned at the release point, the two wheels having different axes of rotation and being spaced apart from each other such that a ball is propelled simultaneously by both wheels.

* * * * *